United States Patent [19]

Mallin

[11] 3,934,279

[45] Jan. 27, 1976

[54] LIQUID CHEMICAL EVAPORATOR FOR FLUSH TANKS

[76] Inventor: Sidney Mallin, 236 Kingston Row, Winnipeg, Manitoba, Canada

[22] Filed: Apr. 22, 1974

[21] Appl. No.: 462,669

[52] U.S. Cl. ..... 4/228

[51] Int. Cl.[2] ..... E03D 9/02

[58] Field of Search..... 220/24 A, 42 B; 239/31 S; 23/267 R, 267 A, 267 B, 272.6 R, 247 E; 4/227, 228; 222/193

[56] References Cited

UNITED STATES PATENTS

| | | | |
|---|---|---|---|
| 444,500 | 1/1891 | Meyer | 23/267 A X |
| 3,423,182 | 1/1969 | Klasky | 23/267 A |
| 3,715,765 | 2/1973 | Yadro | 4/228 |
| 3,778,849 | 12/1973 | Foley | 4/228 |

*Primary Examiner*—Stanley H. Tollberg
*Assistant Examiner*—Norman L. Stack, Jr.
*Attorney, Agent, or Firm*—Stanley G. Ade

[57] ABSTRACT

A canister is adapted to be hung in a toilet tank with the lower open end below the normal water level in the tank when the tank is full. A reservoir is situated at the upper end of the canister and communicates with the main portion of the canister and an evaporative liquid is placed in the reservoir. A divider separates the reservoir into two portions, one portion communicating with the main portion of the canister. As the water in the tank empties, air is drawn through the liquid and evaporates some of the liquid and when the tank fills, this air is once again bubbled through the liquid and expelled into the tank, it being understood that the evaporative liquid is preferably provided with deodorant properties.

9 Claims, 6 Drawing Figures

LIQUID CHEMICAL EVAPORATOR FOR FLUSH TANKS

BACKGROUND OF THE INVENTION

This invention relates to new and useful improvements in deodorizers for toilet tanks.

It is common in such devices, to place a chemical in a container and to depend upon the normal flow of air into and out of the container as it is being emptied or filled with water or the like, to evaporate a quantity of chemical or deodorant and to dispense the resultant vapor into the surrounding air.

This is not particularly satisfactory due to the fact that there is no control over the amount of evaporation and this evaporation varies depending upon the quantity of chemical remaining. The temperature also effects the evaporation and the movement of air is not normally sufficient to supply the required deodorant action.

SUMMARY OF THE INVENTION

The present device overcomes these disadvantages by providing a positive air displacement in a container as the tank empties and fills, this displaced air causing air to bubble through a deodorant liquid container in a reservoir thus giving a greater amount of evaporation than is normal and supplying deodorized air to the toilet tank each time it is emptied and filled.

The principal object and essence of the invention is to provide a device of the character herewithin described which draws air through an evaporative liquid as the tank empties and then forces this air once again through the evaporative liquid as the tank fills and expels the air into the air space above the water level in the conventional toilet tank. This means that each time the tank empties and fills, a quantity of deodorized air is expelled into the surrounding area.

Another object of the invention is to provide a device of the character therewithin described which is not generally affected by ambient temperatures inasmuch as it is contained within a partially closed reservoir.

Another object of the invention is to provide a device of the character herewithin described which is easily suspended within a conventional toilet tank and in which the deodorant liquid is readily placed within the reservoir whenever required.

A still further object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

BRIEF DESCRIPTION OF THE FIGURES

In the drawings like characters of reference indicate corresponding parts in the different figures.

DETAILED DESCRIPTION

Figure 1:
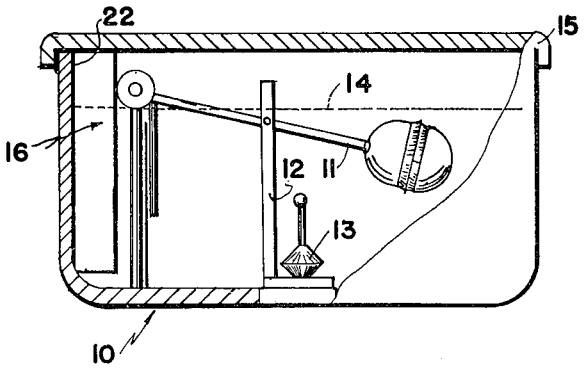
FIG. 1 is a cross sectional view of a conventional toilet tank shown schematically with the device situated in one end thereof.
Figure 2:
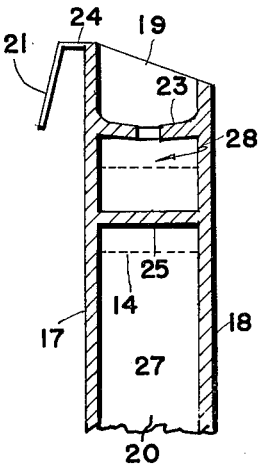
FIG. 2 is a vertical cross section of the device per se substantially along the line 2—2 of FIG. 3.

Proceeding therefore to describe the invention in detail, reference should first be made to FIG. 1 in which 10 illustrates generally, a conventional toilet tank having a ball valve device 11 situated therein and an overflow tube 12 and a discharge device 13 all of which are conventional. The ball valve assembly 11 controls the water level and reference character 14 shows a conventional water level normally used within toilet tanks. A relatively loose fitting cover 15 engages the open upper side of the toilet tank.

The invention is collectively designated by reference character 16 and, in this embodiment, consists of a substantially cubical canister having rear and front walls 17 and 18 and side walls 19. It is provided with an open base 20 although the base may be in the form of a panel with one or more apertures therein.

U-shaped clips 21 are secured to the rear panel 17 adjacent the upper edge thereof and hook over the edge 22 of the toilet tank 10 so that the device can hang therein as shown in FIG. 1 with the cover 15 engaged over the clips as clearly shown. This means that when the device is in position as shown in FIG. 1 and the tank is full with the water level indicated by reference character 1, there is water within the canister 16 which has entered through the open base 20 and the water level within the canister is, of course, similar to the water level within the tank.

Figure 4:
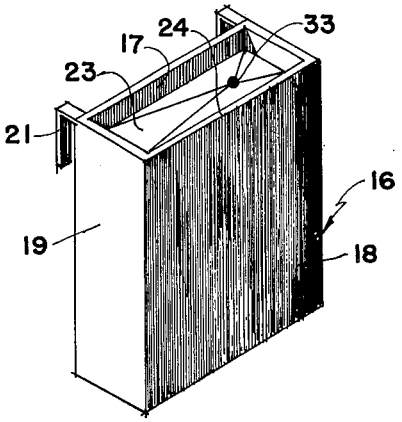
FIG. 4 is an isometric view of the device per se.

In the embodiment illustrated, an upper side 23 extends across the canister spaced below the upper edges 24 of the canister as shown in FIG. 4.

A baffle 25 extends from one side 19 and the front and rear sides 17 and 18, and this terminates spaced from the other side wall as indicated by reference character 26. This defines a main portion or chamber 27 below the baffle and a reservoir collectively designated 28 above the baffle and between baffle 25 and the upper side 23, and it should be observed that when the canister is in position as shown in FIG. 1, the water level 14 is always below the baffle 25.

As mentioned previously, the baffle 25 terminates short of one end wall 19 and a vertical wall 29 extends upwardly from this end and terminates spaced below the upper sides 23 and the side wall 19 and the vertical wall 29, define a vertical passageway 30 communicating between the main chamber 27 and the reservoir 28.

Figure 3:
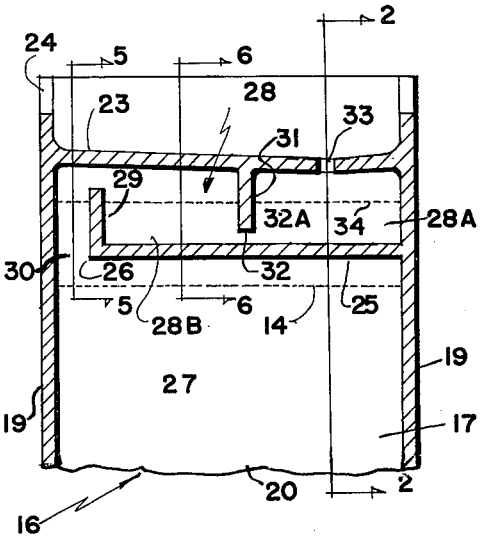
FIG. 3 is a cross sectional view of the device per se at right angles to the view shown in FIG. 2.

The reservoir 28 is divided into two portions 28A and 28B by means of a wall 31 which spans the reservoir and depends from the upper side of the canister. This wall terminates spaced above the baffle as shown in FIG. 3 and the lower edge 32 of this wall defines, with the baffle 25, a horizontal passageway or connection between the two portions 28A and 28B of the reservoir. It should also be noted that vertical passageway 30 communicates with the portion 28B of the reservoir.

An aperture 33 of the like, is formed through the upper side 23 of the canister and communicates with the other portion 28A of the reservoir and reference to FIG. 4 will show that this upper side 23 of the canister may be sloped downwardly towards this aperture 33 so that any liquid such as a deodorant liquid poured into the top of the canister will run through the aperture 33 and into the reservoir 28.

In use, the canister is hung within the tank as shown in FIG. 1 and an evaporative liquid chemical or the like is poured into the top of the canister and enters the reservoir 28 through the aperture 33 to a maximum level indicated by the dotted line 34. This maximum level is established at a level that will ensure that no liquid chemical can be siphoned into the vertical passage 30 or forced out of the reservoir 28 through the opening 33, by the passage of air therethrough.

When installed in the toilet tank, water enters the canister through the open base 20 and into the portion 27 to equal the level of the water within the tank.

When flushing action is initiated in the tank, the water level in the tank drops and water in the portion 27 of the canister also drains from the open lower side 20 thereof thus creating a partial vacuum in the portion 27. This acts through vertical passageway 30, upon the liquid in the portion 28B of the reservoir 28, causing the transfer of liquid from the portion 28A through the horizontal passageway 32 until the liquid level in the chamber 28A drops below the lower edge of the wall 31 thus allowing the passage of air through aperture 33 and through the horizontal passageway 32 whereupon the air passes through the liquid chemical in the chamber 28B of the reservoir in order to break the vacuum. In passing through the liquid chemical, the air evaporates a quantity of this liquid chemical and carries the resulting vapour into the portion 27 of the canister.

When flushing action is completed in the tank 10, and this tank is being re-filled in the normal way, water enters the lower end 20 of the canister and the portion 27. As this water level rises, it compresses the mixture of air and chemical vapor that is in the portion 27, causing this mixture to move through the vertical passageway 30 and into the chamber 28B of the reservoir 28. This forces the liquid chemical in the chamber 28B to move into chamber 28A through the horizontal passageway 32A until the liquid level in the chamber 28B has dropped sufficiently to allow the passage of air through the passageway 32A, said air passing through the liquid chemical in the chamber 28A to relieve the pressure built up when the air in the portion 27 was displaced by the water entering same.

In passing through the liquid chemical this second time, the air evaporates a further quantity of chemical and carries the resultant vapours out of the chamber 28A and through the filling aperture 33 into the tank 10 where the mixture of air and chemical vapour mixes with the balance of air being displaced as the tank 10 is being filled. A quantity of the resultant mixture of air and chemical vapour therefore passes out of the tank with the air that is being displaced out of the tank as the tank is being refilled.

This automatic action evaporates a quantity of the liquid each time the tank is emptied and filled and mixes the resultant vapour with air for discharge from the tank on each cycle.

Figure 5:
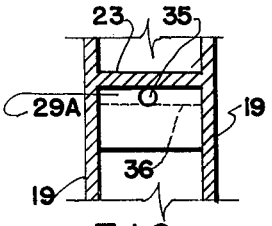
FIG. 5 is a fragmentary cross sectional view substantially along the line 5—5 of FIG. 3.
Figure 6:
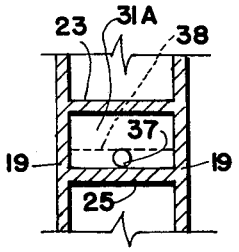
FIG. 6 is a view similar to FIG. 5, but substantially along the line 6—6 of FIG. 3.

FIGS. 5 and 6 show an alternate construction and dealing first with FIG. 5, the vertical wall 29A extends all the way to the upper wall 23 and at least one aperture 35 is formed through this wall adjacent the upper side 23 to permit communication between chamber 28B and vertical passageway 30.

The dotted line 36 in FIG. 5 indicates the top of this vertical wall 29 corresponding to the upper side in FIG. 3.

FIG. 6 shows the vertical wall 31A corresponding to the vertical wall 31 in the previous embodiment. In this embodiment, the lower edge of this wall extends to the baffle 25 and at least one aperture 37 is formed through the wall 31A adjacent the baffle 25 and acts as the horizontal passageway between chambers 28A and 28B.

Once again the dotted line 38 illustrates the lower edge of the vertical wall 31 in the previously described embodiment.

The apertures 35 and 37 act in a similar manner to the horizontal passageways hereinbefore described.

Since various modifications can be made in my invention as hereinabove described, and many apparently widely different embodiments of same made within the spirit and scope of the claims within departing from such spirit and scope, it is intended that all matter contained in the accompanying specification shall be interpreted as illustrative only and not in a limiting sense.

What I claim as my invention is:

1. A container for dispensing a deodorizing vapour into the air space of an associated toilet tank, comprising in combination a canister, means for detachable mounting said canister within the associated toilet tank, said canister having an open base which is situated between the normal water level of said tank when installed therein, a baffle spanning said canister to define a chamber therebelow and a liquid deodorizor receiving reservoir thereabove, a closed upper side to said reservoir, said reservoir being situated between said upper side and said baffle, said baffle being above the said normal water level in the associated tank, first passageway means communicating between said chamber and said reservoir adjacent said upper side of said reservoir and above the level of the liquid deodorizor in said reservoir, means in said reservoir dividing same into two portions, said last mentioned means having second passageway means communicating between said portions substantially at the base of said last mentioned means, and opening means in the upper side of said canister communicating with one portion of said reservoir, said first passageway means communicating with the other portion of said reservoir whereby emptying of the associated tank transfers the deodorizor liquid in said one portion of said reservoir to said other portion of said reservoir by differential air pressure so that air is drawn through said opening means, through said second passageway means, bubbles through the liquid in said other portion of said reservoir, through said first passageway means into said chamber, and filling of the associated tank compresses the air in said chamber thereby transferring to said liquid from said other portion of said reservoir to said one portion of said reservoir so that the air in said chamber passes through said first passageway means, through said second passageway means and bubbles through the liquid in said one portion of said reservoir and through said opening means carrying with it an evaporated fraction of said liquid within said reservoir.

2. The device according to claim 1 in which said baffle terminates spaced from one end wall of said canister, a vertical wall extending upwardly from said baffle at the end terminating spaced from said one wall of said canister, to said upper side of said reservoir, said vertical wall being apertured adjacent the upper side thereof and communicating with said other portion of said reservoir, said apertured vertical wall and said one end wall of said canister defining said first passageway means.

3. The device according to claim 1 in which said means in said reservoir dividing same into two portions takes the form of at least one wall depending from the upper side of said reservoir and terminating spaced from said baffle to define said second passageway means between said portions of said reservoir.

4. The device according to claim 3 in which said baffle terminates spaced from one end wall of said canister, a vertical wall extending upwardly from said baffle at the end terminating spaced from said one end wall of said canister, said vertical wall and said one end wall of said canister defining said first passageway means.

5. The device according to claim 3 in which said baffle terminates spaced from one end wall of said canister, a vertical wall extending upwardly from said baffle at the end terminating spaced from said one wall of said canister, to said upper side of said reservoir, said vertical wall being apertured adjacent the upper side thereof and communicating with said other portion of said reservoir, said apertured vertical wall and said one end wall of said canister defining said first passageway means.

6. The device according to claim 1 in which said baffle terminates spaced from one end wall of said canister, a vertical wall extending upwardly from said baffle at the end terminating spaced from said one end wall of said canister, said vertical wall and said one end wall of said canister defining said first passageway means.

7. The device according to claim 6 in which said means in said reservoir dividing same into two portions takes the form of at least one wall extending between the upper side of said reservoir and said baffle, said one wall being apertured adjacent the lower edge thereof, constituting said second passageway means.

8. The device according to claim 1 in which said means in said reservoir dividing same into two portions takes the form of at least one wall extending between the upper side of said reservoir and said baffle, said one wall being apertured adjacent the lower edge thereof, constituting said second passageway means.

9. The device according to claim 8 in which said baffle terminates spaced from one end wall of said canister, a vertical wall extending upwardly from said baffle at the end terminating spaced from said one wall of said canister, to said upper side of said reservoir, said vertical wall being apertured adjacent the upper side thereof and communicating with said other portion of said reservoir, said apertured vertical wall and said one end wall of said canister defining said first passageway means.

* * * * *